US009406476B2

(12) United States Patent
Corazza et al.

(10) Patent No.: US 9,406,476 B2
(45) Date of Patent: Aug. 2, 2016

(54) COMBINATION OF MATERIALS FOR MERCURY-DISPENSING DEVICES AND DEVICES CONTAINING SAID COMBINATION OF MATERIALS

(71) Applicant: SAES GETTERS S.P.A., Lainate (MI) (IT)

(72) Inventors: Alessio Corazza, Como (IT); Diego Di Giampietro, Pescara (IT); Gianni Santella, Tomimparte (IT)

(73) Assignee: SAES GETTERS S.P.A., Lainate (MI) (IT)

( * ) Notice: Subject to any disclaimer, the term of this patent is extended or adjusted under 35 U.S.C. 154(b) by 0 days.

(21) Appl. No.: 14/438,466

(22) PCT Filed: Sep. 15, 2014

(86) PCT No.: PCT/IB2014/064523

§ 371 (c)(1),
(2) Date: Apr. 24, 2015

(87) PCT Pub. No.: WO2015/052604

PCT Pub. Date: Apr. 16, 2015

(65) Prior Publication Data

US 2015/0294830 A1 Oct. 15, 2015

(30) Foreign Application Priority Data

Oct. 8, 2013 (IT) ..... MI2013A1658

(51) Int. Cl.

| | |
|---|---|
| ***B22F 1/00*** | (2006.01) |
| ***H01J 7/18*** | (2006.01) |
| ***H01J 7/20*** | (2006.01) |
| ***H01J 9/395*** | (2006.01) |
| ***H01J 61/28*** | (2006.01) |
| ***C22C 9/02*** | (2006.01) |
| ***C22C 30/02*** | (2006.01) |
| ***C22C 30/06*** | (2006.01) |
| *C22C 1/04* | (2006.01) |

(52) U.S. Cl.

CPC ..... *H01J 7/183* (2013.01); *B22F 1/0003* (2013.01); *C22C 9/02* (2013.01); *C22C 30/02* (2013.01); *C22C 30/06* (2013.01); *H01J 7/20* (2013.01); *H01J 9/395* (2013.01); *H01J 61/28* (2013.01); *C22C 1/045* (2013.01); *C22C 1/0425* (2013.01); *C22C 1/0491* (2013.01)

(58) Field of Classification Search

None

See application file for complete search history.

(56) References Cited

U.S. PATENT DOCUMENTS

| | | | | |
|---|---|---|---|---|
| 3,657,589 | A | 4/1972 | Della Porta et al. | |
| 4,278,908 | A | 7/1981 | Antonis | |
| 4,823,047 | A | 4/1989 | Holmes et al. | |
| 5,825,127 | A | 10/1998 | Weinhardt | |
| 5,876,205 | A * | 3/1999 | Schiabel | H01J 7/10 252/181.2 |
| 6,489,721 | B1 * | 12/2002 | Haitko | H01J 61/02 313/490 |

FOREIGN PATENT DOCUMENTS

| | | |
|---|---|---|
| EP | 0669639 | 8/1995 |
| EP | 0737995 | 10/1996 |
| WO | 97/19461 | 5/1997 |

OTHER PUBLICATIONS

PCT International Search Report mailed on Jan. 9, 2015 for PCT/IB2014/064523 filed on Sep. 15, 2014 in the name of SAES GETTERS S.P.A.

PCT Written Opinion mailed on Jan. 9, 2015 for PCT/IB2014/064523 filed on Sep. 15, 2014 in the name of SAES GETTERS S.P.A.

Corazza A et al: "Mercury dosing solutions for fluorescent lamps", Journal of Physics: Applied Physics, Institute of Physics Publishing LTD, GB, vol. 41, No. 14 (2008).

* cited by examiner

*Primary Examiner* — George Wyszomierski
*Assistant Examiner* — Ngoclan T Mai
(74) *Attorney, Agent, or Firm* — Steinfl & Bruno, LLP

(57) ABSTRACT

An improved mercury-dispensing combination of materials is made up of a compound A including mercury and a second metal selected among titanium, zirconium and mixtures thereof and an alloy or an intermetallic compound B including copper and tin, said mercury-dispensing combination of materials further containing an amount of oxygen comprised between 0.03% and 0.48% with respect to the overall weight of the composition A+B. It is also possible to add a getter material C that includes metals such as titanium, zirconium, tantalum, niobium, vanadium and mixtures thereof or their alloys with other metals such as nickel, iron, aluminum.

22 Claims, No Drawings

COMBINATION OF MATERIALS FOR MERCURY-DISPENSING DEVICES AND DEVICES CONTAINING SAID COMBINATION OF MATERIALS

CROSS REFERENCE TO RELATED APPLICATIONS

The present application is the US national stage of International Patent Application PCT/IB2014/064523 filed internationally on Sep. 15, 2014 which, in turn, claims priority to Italian Patent Application No. MI2013A001658 filed on Oct. 8, 2013.

The present invention relates to a combination of materials for the production of mercury-dispensing devices and to the mercury-dispensing devices thus produced.

The use of small amounts of mercury in lighting devices such as, for example, high pressure mercury discharge lamps, various kinds of alphanumeric displays, UV lamps and, particularly, fluorescent lamps is well known in the art.

An accurate and controlled dosage of mercury inside these devices is extremely important for the quality of the devices and most of all for environmental reasons. In fact, the high toxicity of this element implies serious problems of ecological nature upon end-life disposal of the devices containing it, or in case of accidental break-up of the devices. These problems of ecological nature impose the use of amounts of mercury as small as possible, compatibly with the functionality of the tubes. These considerations have been lately included also in the legislative sphere, and the trend of the recent international regulations is to establish upper limits for the amount of mercury which can be introduced into the devices. For example, for standard fluorescent lamps the use of a total amount of Hg not greater than a few milligrams per lamp has been prescribed by the European RoHS Directive: less than 3 mg in linear Tri-band phosphor with normal lifetime and a tube diameter ≥9 mm and Tri-band phosphor with long lifetime (≥25,000 h); less than 3.5 mg in linear Tri-band phosphor with normal lifetime and a tube diameter ≥17 mm; less than 5 mg in linear Tri-band phosphor with long lifetime (≥25,000 h).

The old method of liquid mercury dosing first of all posed problems concerning not only the storing and handling of mercury in the plants for the production of tubes due to its high vapor pressure also at room temperature, but also the difficulty in precisely and reproducibly dosing volumes of mercury in the order of fractions of microliter.

These drawbacks led to the development of various techniques alternative to the use of liquid mercury in free form.

The use of liquid mercury contained in capsules, usually made of glass but possibly also metallic, is disclosed in several prior art documents as for example, respectively, in U.S. Pat. No. 4,823,047 and U.S. Pat. No. 4,278,908. After closing the lamp tube, the mercury is released within the lamp by means of a heat treatment which causes the breakage of the container. These methods generally have some drawbacks. First of all, the production of the capsules and their mounting inside the tubes may be complicated, especially when they have to be introduced inside small-size tubes. Secondly, the breakage of the capsule, particularly if it is made of glass, may produce fragments of material which can jeopardize the tube quality. Moreover, these systems still have the drawback of employing liquid mercury, and therefore they do not completely solve the problem of the precise and reproducible dosage of few milligrams of mercury.

These problems have been overcome by U.S. Pat. No. 3,657,589 in the name of the applicant, which disclosed the use of intermetallic compounds of mercury having the general formula $Ti_xZr_yHg_z$, wherein x and y may vary between 0 and 13, the sum (x+y) may vary between 3 and 13 and z may be 1 or 2.

These compounds have a temperature of mercury-release start variable according to the specific compound, however they are all stable up to about 450° C. both in the atmosphere and in evacuated volumes, thus resulting compatible with the operations for the assembly of the lighting devices, during which the mercury-dispensing devices may reach temperatures of about 400° C. without risks of mercury loss. After closing the tube, the mercury is released from the above-cited compounds by an activation operation, which is usually carried out by heating the material at 900° C. for about 30 seconds. This heating may be accomplished by laser radiation, or by induction heating of the dispenser device based on of the Hg-dispensing compound. The use of the $Ti_3Hg$ compound is usually realized in the form of compressed powder in a ring-shaped container or of compressed powder in pills or of a powder-coated metallic strip obtained by cold rolling.

These materials offer various advantages with respect to the prior art. As mentioned above, they avoid the risks of mercury evaporation during the cycle of production of the tubes, in which temperatures of about 350-400° C. may be reached. Moreover, as described in the cited U.S. Pat. No. 3,657,589, a getter material can be easily added to the mercury-dispensing compound with the purpose of chemisorption of gases such as CO, $CO_2$, $O_2$, $H_2$ and $H_2O$, which would interfere with the tube operation; the getter is activated during the same heat treatment for the release of mercury. Finally, the released amount of mercury is easily controllable and reproducible.

Despite their good chemi-physical characteristics and their great ease of use, these materials have the drawback that the contained mercury is not completely released during the activation treatment. This characteristic, together with the fact that the tube needs a certain amount of free mercury that is consumed during its life cycle, leads to the necessity of introducing into the device an amount of mercury which is about double than that which would theoretically be necessary.

In order to overcome these problems, the addition of Ni or Cu powders to the $Ti_3Hg$ or $Zr_3Hg$ compounds had been studied to favor the release of mercury. This solution is not completely satisfactory because, as it happens in the methods employing capsules, mercury bursts out violently and can cause damages to portions of the tube if the activation process is not precisely controlled; moreover the manufacturing of the container is quite complicated, since it requires the welding of small-size metallic members.

EP 0669639, in the applicant's name, discloses a mercury-dispensing intermetallic compound A including mercury and a second metal selected among titanium, zirconium and mixtures thereof, and an alloy or an intermetallic copper-based compound B including tin, indium, silver or combinations thereof and possibly a third metal selected among the transition elements, wherein the transition metal is present in an amount not greater than 10% of the overall weight of component B.

Among the above-mentioned compositions A+B, those including Sn—Cu containing copper in the range between 3% and 63% on a weight basis are particularly preferred for the easy preparation and the good mechanical characteristics, and most of all the composition corresponding to the non-stoichiometric compound $Cu_6Sn_5$.

A+B compositions that have been disclosed by EP 0669639, commonly named as high-yield Hg dispensing compositions, are characterized by the possibility to obtain, even at a relatively low temperature in the range 750-900° C., an effective Hg dispensation. In particular, those compositions are capable of releasing amounts of mercury higher than 60% during the activation step, even after partial oxidation, so as to be able to reduce the total amount of employed mercury. Drawbacks with these compositions are related to issues in the adherence of the powder mixture to the metallic container or support and in possible material detachment and flake-off with subsequent presence of loose particles in the lamp and reduction of the released mercury dose. Another drawback is that a partial premature mercury loss can occur from the EP 0669639 compositions in manufacturing processes with steps characterized by temperatures above 450° C., as for example in lamps productions carried out on high-temperature vertical lines.

An important advantage of the compositions according to the invention is related to the fact that the adhesion of the new mercury releasing powder mixture on the metallic holder or support is better than that of compounds known in the prior art, avoiding risks of powder loss or detachment from the support. This feature allows a more reliable handling and activation of the dispensing devices without problems of possible particles loss or material peel-off that can induce defects in the lamps or a reduction of the released mercury. A second technical advantage is that the premature mercury loss in the range 450°-550° C. possibly achieved in high-temperature lamp production processes is significantly lower with respect to the EP 0669639 compositions, despite the fact that the activation temperature range is comparable.

Therefore, the object of the present invention is to provide an improved combination of materials for dispensing mercury in the lighting devices which allows to overcome one or more drawbacks of the prior art, in particular a combination allowing an effective Hg release only at temperatures greater than 750° C., and a mechanically stable dispenser structure which can be easily produced with commonly known metallurgical techniques.

According to the present invention, these and other objects are achieved by using a mercury-dispensing combination of materials made up of

- a mercury-dispensing compound A including mercury and a second metal selected among titanium, zirconium and mixtures thereof and
- an alloy or an intermetallic compound B including copper and tin, copper being present in an amount comprised between 35% and 90% weight percent with respect to the weight of said compound B, characterized in that said mercury-dispensing combination of materials further contains an amount of oxygen comprised between 0.03% and 0.48% with respect to the overall weight of the composition A+B, preferably between 0.06% and 0.39% wt/wt. The above mentioned amounts of oxygen refer to an average content of $O_2$ in the A+B materials combination, measurable for example by means of an automatic gas analyzer on a suitable quantity of A+B mixture (at least 50 mg).

The alloy or intermetallic compound B could optionally further contain a third metal selected among the transition elements, with particular reference to iron, nickel, manganese and zinc wherein the transition metals are present in an amount not greater than 1% of the overall weight of compound B. In a preferred embodiment, the amount of transition metals does not exceed the amount corresponding to 0.5% weight percent of compound B. In another embodiment the amount of zinc or manganese in the alloy or intermetallic compound B does not exceed 0.3% weight percent of compound B or in a preferred embodiment 0.15% weight percent of compound B.

A mercury-dispensing device of the invention containing a combination of said materials A and B, can optionally further contain a getter material C, both mixed together with the materials A and B or present in a separate layer.

Further objects and advantages of the present invention will be apparent from the following detailed description referring to some not limiting embodiments.

Component A of the combination of the present invention, hereafter also defined mercury dispenser, is a compound containing one or more intermetallic materials corresponding to formula $Ti_xZr_yHg_z$, as disclosed in the cited U.S. Pat. No. 3,657,589, to which reference is made for further details. Among the materials corresponding to said formula, $Zr_3Hg$ and, particularly, $Ti_3Hg$ are preferred.

Component B of the combination of the present invention has the function of favoring the release of mercury from component A, and hereafter will also be defined promoter. This component is an alloy or an intermetallic compound including copper and tin, copper being present in an amount comprised between 35% and 90% weight percent with respect to the weight of said compound B. It is also possible to use as component B alloys of three or more metals obtained from the preceding ones by adding one or more elements selected among the transition metals in an amount not greater than 1% of the overall weight of component B. Preferably the transition metals are selected among iron, nickel, manganese and zinc. Preferably the amount of transition metals in the alloy or intermetallic compound B does not exceed the amount corresponding to 0.5% weight percent of compound B; in a more preferred embodiment the amounts of zinc or manganese are less than 0.3% weight percent of the total amount of compound B or even more preferably they do not exceed 0.15%.

The weight ratio between components A and B of the combination of the invention may vary within a wide range, but it is generally included between 10:1 and 1:10, and preferably between 7:1 and 1:5.

The best results are obtained when components A and B of the combination of the invention are in the form of a fine powder, having a particle size lower than 250 μm and preferably between 1 and 125 μm; in more general terms it is intended that at least 95% of the employed particles have grain size features according to the above limits.

The present invention, in a second aspect thereof, relates to the mercury-dispensing devices which use the above-described combinations of A and B materials.

Some classes of lighting devices for which the mercury dispensers are intended further require, for their correct operation, the presence of a getter material C which removes traces of gases such as CO, $CO_2$, $H_2$, $O_2$ or water vapor: it is the case, for example, of fluorescent lamps that after the production process have a not negligible impurities level in the filling gas. For these applications, the getter can be advantageously introduced by means of the same mercury-dispensing device, according to the manners described in the cited U.S. Pat. No. 3,657,589.

Examples of getter materials include, among the others, metals such as titanium, zirconium, tantalum, niobium, vanadium and mixtures thereof, or alloys thereof with other metals such as nickel, iron, aluminum, like the alloy having a weight percentage composition Zr 86%-Al 14%, or the intermetallic compounds $Zr_2Fe$ and $Zr_2Ni$. The getter is activated during the same heat treatment by which mercury is released inside the tube.

The getter material C may be present in various physical forms, but it is preferably employed in the form of a fine powder, having a particle size lower than 250 μm and preferably between 1 and 125 μm.

The ratio between the overall weight of the A and B materials and that of the getter material C may generally range from about 10:1 to 1:10, and preferably between 5:1 and 1:2.

In a first possible embodiment, the devices of the invention can simply consist of a layer of powder mixture of the A and B (and optionally C) materials compressed on a metallic support or container which for ease of production generally has a cup shape or a ring shape. Supports acting as powders holders, such as those based on flat metallic surfaces, are particularly advantageous; such metallic supports are known in the technical field and represent an advantageous means to incorporate the mercury source within the fluorescent lamps. They are described, for example, in WO 97/019461 in the applicant's name and in U.S. Pat. No. 5,825,127, whose teachings are herein incorporated by reference.

In the case of supported materials, the device may be made in the shape of a strip, preferably made of nickel-plated steel, onto which the A and B (and optionally C) materials are adhered by cold compression (rolling). In this case, whenever the presence of the getter material C is required, materials A, B and C may be mixed together and rolled on one or both faces of the strip but in a preferred embodiment materials A and B are placed on one surface of the strip and material C on the opposite surface.

In a second possible embodiment of the device according to the present invention the dispensing device has a ring-like configuration obtained by bending a metallic strip holding the A and B (and possibly C) materials and welding the strip overlapped extremities. Over the strip the A and B materials mixture is deposited and compressed in tracks and possibly separate tracks of a getter material can be present. Number and disposition of tracks and closing means for the support can vary without departing from the scope of the present invention.

One of the preferred ways to produce the support is to deposit the tracks by means of the cold rolling technique, i.e. by depositing tracks of the materials in powder form on a substrate and then by passing over a compressing roll. The support is then cut onto the desired length and given its final shape. The substrate is typically made of a metallic material: for example suitable materials are nickel-plated iron, nickel-iron alloys, stainless steel. With regards to the height of the tracks, it is advantageously less than 0.5 mm, the lowest limit given by the height of a particle monolayer.

Another advantageous variant for a device comprising the mercury dispensing composition to carry out the method according to the present invention consists of the metallic strip formed in a V shape by folding it approximately in the center; on the metallic strip is present at least a track of mercury releasing powders according to the present invention. In another variant the V shape support can host a track of mercury releasing powders and a track of getter alloy.

The method includes the step of introducing inside the tube the above-described mercury-dispensing combination of materials, preferably by means of one of the above-described devices, and then the combination heating step to release mercury. The heating step may be carried out with any suitable means such as, for example, by radiation, by high-frequency induction heating or by having a current flow through the support when the latter is made of a material having a high electric resistivity. The heating is applied at a temperature which causes the release of mercury from the mercury-dispensing combination, comprised between 700 and 900° C. for a time of about 10 seconds to one minute.

The invention will be further illustrated by the following examples. These non-limiting examples illustrate some embodiments intended to teach to those skilled in the art how to put in practice the invention and to show the best mode to carry out the invention.

EXAMPLES 100 grams of a mercury-dispensing mixture M1 are prepared according to the present invention by mixing 55 grams of a TiHg alloy powder containing 54% by weight of mercury and 45 grams of a CuSn alloy powder containing 85% by weight of copper and 15% by weight of Sn; the powder mixture has an average $O_2$ content of 0.333% wt;

100 grams of a mercury-dispensing mixture M2, with the same composition of mixture M1, but with an average oxygen content of 0.076%, are prepared according to the invention.

Also 100 grams of a mercury-dispensing mixture M3 are prepared according to the present invention by mixing 55 grams of a TiHg alloy powder containing 54% by weight of mercury and 45 grams of a CuSn alloy powder containing 41% by weight of copper and 59% by weight of tin; the powder mixture has an average $O_2$ content of 0.37% wt;

As comparative examples also 100 g of mercury-dispensing mixtures C1 and C2 are prepared, with the same composition of M1 and M2 but with an average oxygen content of 0.027% wt and of 0.519% wt.

The five mixtures are used to prepare samples of powder-coated strips applying each powder mixture on a nickel-plated iron strip by cold rolling.

The five different coated strips are then evaluated in terms of Hg yield at 850° C. for a total time of 30 seconds and in terms of adherence of the coating on the metallic substrate. In order to measure Hg yield, three samples of coated strip for each composition are tested. The samples are RF heated in a glass bulb under vacuum (pressure below $1*10^{-3}$ mbar) at 850° C. for 20 seconds after a ramp-up time of 10 seconds: the measure of the sample weight difference after the applied heating process indicates the mercury release and, knowing the initial Hg content, the Hg yield is determined.

On other four samples for each composition the adherence of the powder mixture on the metallic strip is checked: a strip sample is bent around a metallic rod having a radius of 15 mm. Powder adherence is judged excellent when no flake-off or defects or cracks are observed on the coating after bending, adherence is good when just minor cracks without peel-off occur in limited areas of the samples (less than 7% of the total coating surface), adherence is not good when powder peel-off occurs or coating cracks are not localized in limited areas.

Data of average Hg yield obtained during activation at 850° C. and results of the adherence tests are reported in the following table:

| ID | Mixture Composition % wt | $O_2$ content % wt | Hg Yield % | Adherence on strip |
|---|---|---|---|---|
| M1 | TiHg + Cu85%Sn15% | 0.333 | 96% | Excellent |
| M2 | TiHg + Cu85%Sn15% | 0.076 | 97% | Good |
| M3 | TiHg + Cu41%Sn59% | 0.370 | 96% | Good |
| C1 | TiHg + Cu85%Sn15% | 0.027 | 97% | Not good |
| C2 | TiHg + Cu85%Sn15% | 0.519 | 87% | Excellent |

The samples show very good yields with the exception of C2 that has a low Hg yield; on the other hand C1 shows coating flake-off problems, whereby only the samples made according to the present invention show both high Hg yield and good/excellent powder adherence.

The invention claimed is:

1. A mercury-dispensing combination of materials, comprising:

a mercury-dispensing powder compound A including mercury and a second metal selected among titanium, zirconium and mixtures thereof; and an alloy or an intermetallic powder compound B including copper and tin, copper being present in an amount comprising between 35% and 90% by weight with respect to the weight of said compound B, wherein the mercury-dispensing combination of materials further contains an amount of oxygen comprised between 0.03% and 0.48% with respect to the overall weight of the mercury-dispensing combination of materials, and wherein the alloy or intermetallic compound B further contains at least a third metal selected among the transition metals iron, nickel, manganese and zinc and wherein the transition metals are present in an amount not greater than 1% of the overall weight of compound B.

2. The mercury-dispensing combination of materials according to claim NM, wherein the amount of transition metals does not exceed an amount corresponding to 0.5% by weight of compound B.

3. The mercury-dispensing combination of materials according to claim 1, wherein the amount of zinc or manganese in the alloy or intermetallic compound B does not exceed 0.3% by weight of compound B.

4. The mercury-dispensing combination of materials according to claim 3, wherein the amount of zinc or manganese in the alloy or intermetallic compound B does not exceed 0.15% by weight of compound B.

5. The mercury-dispensing combination of materials according to claim 1, wherein the mercury-dispensing compound A is selected among compounds containing one or more intermetallic materials corresponding to formula $Ti_xZr_yHg_z$, wherein x is an integer from 0 to 13, y is an integer from 0 to 13, the sum (x+y) is an integer from 3 to 13, and z is an integer 1 or 2.

6. The mercury-dispensing combination of materials according to claim 1, wherein the weight ratio between components A and B of the combination is included between 10:1 and 1:10.

7. The mercury-dispensing combination of materials according to claim 1, wherein the amount of oxygen is between 0.06% and 0.39% with respect to the overall weight of the composition.

8. The mercury-dispensing combination of materials according to claim 1, wherein the mercury-dispensing compound A is Zr3Hg or Ti3Hg.

9. The mercury-dispensing combination of materials according to claim 1, wherein the weight ratio between components A and B of the combination is included between 7:1 and 1:5.

10. A mercury-dispensing device containing the mercury-dispensing combination of materials according to claim 1.

11. The mercury-dispensing device according to claim 10, wherein component B is present in the form of a coating of a metallic support, and component A as a powder adhered to component B by rolling.

12. The mercury-dispensing device according to claim 10, wherein components A and B are in the form of a fine powder having a particle size lower than 250 μm.

13. The mercury-dispensing device according to claim 10, wherein at least a getter material C is added.

14. The mercury-dispensing device according to claim 13, wherein the getter material C includes metals selected among titanium, zirconium, tantalum, niobium, vanadium, mixtures thereof and their alloys with other metals selected among nickel, iron and aluminum.

15. The mercury-dispensing device according to claim 13, wherein the ratio between the overall weight of the A and B materials and the weight of the getter material C ranges from about 10:1 to 1:10.

16. The mercury-dispensing device according to claim 10, wherein the mercury-dispensing combination of materials adheres to a supporting material having the shape of a strip made of nickel-plated steel.

17. The mercury-dispensing device according to claim 16, wherein materials A, B and C are mixed together and rolled on one or both faces of the strip.

18. The mercury-dispensing device according to claim 16, wherein materials A and B are placed on one surface of the strip and material C on the opposite surface with respect to materials A and B.

19. The mercury-dispensing device according to claim 10, wherein components A and B are in the form of a fine powder having a particle size between 1 and 125 μm.

20. The mercury-dispensing device according to claim 13, wherein the ratio between the overall weight of the A and B materials and the weight of the getter material C ranges between 5:1 and 1:2.

21. The mercury-dispensing device according to claim 13, wherein the getter material C includes an alloy having a weight percentage composition Zr 86%-Al 14%.

22. The mercury-dispensing device according to claim 13, wherein the getter material C includes an intermetallic compound $Zr_2Fe$ or $Zr_2Ni$.

* * * * *